US009103152B2

(12) United States Patent
Goodman et al.

(10) Patent No.: US 9,103,152 B2
(45) Date of Patent: Aug. 11, 2015

(54) LEADING END ASSEMBLIES FOR MOVABLE PARTITIONS INCLUDING SENSOR ASSEMBLIES, MOVABLE PARTITION SYSTEMS INCLUDING SENSOR ASSEMBLIES AND RELATED METHODS

(71) Applicant: Won-Door Corporation, Salt Lake City, UT (US)

(72) Inventors: E. Carl Goodman, Bountiful, UT (US); Tracy M. Knight, Kearns, UT (US)

(73) Assignee: Won-Door Corporation, Salt Lake City, UT (US)

( * ) Notice: Subject to any disclaimer, the term of this patent is extended or adjusted under 35 U.S.C. 154(b) by 0 days.

(21) Appl. No.: 14/041,944

(22) Filed: Sep. 30, 2013

(65) Prior Publication Data

US 2014/0041813 A1 Feb. 13, 2014

Related U.S. Application Data

(62) Division of application No. 13/165,165, filed on Jun. 21, 2011, now Pat. No. 8,544,524.

(51) Int. Cl.

| | |
|---|---|
| ***E05D 15/26*** | (2006.01) |
| ***E05F 15/10*** | (2006.01) |
| ***E05F 15/48*** | (2015.01) |
| ***E05F 15/603*** | (2015.01) |
| ***E05F 15/605*** | (2015.01) |

(52) U.S. Cl.

CPC ..... *E05F 15/10* (2013.01); *E05D 15/26* (2013.01); *E05F 15/48* (2015.01); *E05F 15/603* (2015.01); *E05F 15/605* (2015.01); *E05Y 2400/44* (2013.01); *E05Y 2900/142* (2013.01); *Y10T 16/35* (2015.01); *Y10T 16/3822* (2015.01)

(58) Field of Classification Search

CPC ..... E05D 15/26

USPC ..... 160/1, 196.1, 188, 199, 201, 84.02, 160/84.08; 180/434–437, 279; 105/163.2; 104/89

See application file for complete search history.

(56) References Cited

U.S. PATENT DOCUMENTS

| | | | |
|---|---|---|---|
| 3,289,741 | A | 12/1966 | Gossling |
| 3,577,679 | A | 5/1971 | Petterborg |

(Continued)

FOREIGN PATENT DOCUMENTS

| | | | |
|---|---|---|---|
| EP | 1471028 | A1 | 10/2004 |
| EP | 1518814 | A1 | 3/2005 |

(Continued)

*Primary Examiner* — Blair M Johnson

(74) *Attorney, Agent, or Firm* — TraskBritt

(57) ABSTRACT

Leading end assemblies for movable partitions may include at least one sensor assembly configured to detect a force applied to a leading surface of a leading structure of the leading end assembly. Movable partition systems may include a plurality of hingedly coupled panels and a leading end assembly. The leading end assembly may include a trolley movably coupled to a track and at least one sensor assembly configured to detect movement of the leading structure relative to the trolley when the movable partition is moved from a retracted position to an extended position. Methods of operating a movable partition may include monitoring a displacement of a leading structure of a leading end assembly of the movable partition relative to another portion of the leading end assembly with a sensor assembly and ceasing movement of the movable partition in response to a signal from the sensor assembly.

19 Claims, 6 Drawing Sheets

(56) References Cited

U.S. PATENT DOCUMENTS

| | | | | |
|---|---|---|---|---|
| 3,720,254 | A | 3/1973 | Smart | |
| 3,773,145 | A | 11/1973 | Drexler | |
| 3,929,077 | A * | 12/1975 | Benndahl | 104/93 |
| 3,955,661 | A | 5/1976 | Popper et al. | |
| 4,042,066 | A | 8/1977 | Noone | |
| 4,133,364 | A | 1/1979 | Smart | |
| 4,300,663 | A | 11/1981 | Hmelovsky et al. | |
| 4,422,029 | A | 12/1983 | Demers et al. | |
| 4,693,340 | A | 9/1987 | Shanks et al. | |
| 4,794,248 | A | 12/1988 | Gray | |
| 4,834,161 | A | 5/1989 | Johnson et al. | |
| 4,924,929 | A | 5/1990 | Johnson et al. | |
| 4,976,337 | A | 12/1990 | Trett | |
| 5,007,496 | A * | 4/1991 | Whitten et al. | 180/401 |
| RE33,668 | E | 8/1991 | Gray | |
| 5,131,506 | A | 7/1992 | Mizuno et al. | |
| 5,162,711 | A | 11/1992 | Heckler | |
| RE34,665 | E | 7/1994 | Strand | |
| 5,625,266 | A | 4/1997 | Stark | |
| 5,636,714 | A | 6/1997 | Viola | |
| 5,676,189 | A * | 10/1997 | Zeeb | 160/331 |
| 6,167,991 | B1 | 1/2001 | Full et al. | |
| 6,626,268 | B1 | 9/2003 | Masuda et al. | |
| 6,662,848 | B2 | 12/2003 | Goodman et al. | |
| 7,066,297 | B2 | 6/2006 | Goodman et al. | |
| 7,093,692 | B2 | 8/2006 | Koura | |
| 7,211,975 | B2 | 5/2007 | Murray et al. | |
| 7,237,655 | B2 | 7/2007 | Kocher | |
| 7,342,370 | B2 | 3/2008 | Greene et al. | |
| 7,478,663 | B2 | 1/2009 | Goodman et al. | |
| 7,503,205 | B2 | 3/2009 | Baillargeon et al. | |
| 7,503,594 | B2 | 3/2009 | Peacock et al. | |
| 7,513,293 | B2 | 4/2009 | Goodman et al. | |
| 7,740,046 | B2 | 6/2010 | Goodman et al. | |
| 7,845,386 | B2 | 12/2010 | Coleman et al. | |
| 7,926,538 | B2 | 4/2011 | Coleman et al. | |
| 8,087,444 | B2 | 1/2012 | Goodman | |
| 8,544,524 | B2 * | 10/2013 | Goodman et al. | 160/199 |
| 2001/0045327 | A1 | 11/2001 | Shemanske et al. | |
| 2004/0094275 | A1 | 5/2004 | Goodman et al. | |
| 2004/0159500 | A1 | 8/2004 | Koura | |
| 2004/0173415 | A1 | 9/2004 | Kocher | |
| 2004/0194386 | A1 | 10/2004 | Albiero | |
| 2005/0131606 | A1 | 6/2005 | Motozawa et al. | |
| 2006/0144643 | A1 | 7/2006 | Koura | |
| 2007/0095488 | A1 | 5/2007 | Huang | |
| 2008/0105387 | A1 | 5/2008 | Coleman et al. | |
| 2008/0105389 | A1 | 5/2008 | Goodman et al. | |
| 2008/0115896 | A1 | 5/2008 | Goodman | |
| 2008/0169069 | A1 | 7/2008 | Coleman et al. | |
| 2008/0184623 | A1 | 8/2008 | Heigl et al. | |
| 2008/0244991 | A1 * | 10/2008 | Coleman et al. | 52/71 |
| 2008/0264578 | A1 | 10/2008 | Goodman et al. | |
| 2009/0120595 | A1 | 5/2009 | Goodman et al. | |
| 2011/0000625 | A1 | 1/2011 | George | |
| 2011/0093095 | A1 | 4/2011 | Goodman et al. | |
| 2011/0186249 | A1 | 8/2011 | Coleman et al. | |
| 2012/0042573 | A1 | 2/2012 | Knight et al. | |
| 2012/0325412 | A1 | 12/2012 | Goodman et al. | |

FOREIGN PATENT DOCUMENTS

| | | | |
|---|---|---|---|
| WO | 8101837 | A1 | 7/1981 |
| WO | 8202787 | A1 | 8/1982 |
| WO | 8809862 | A1 | 12/1988 |
| WO | 0142120 | A1 | 6/2001 |
| WO | 2004096690 | A1 | 11/2004 |

* cited by examiner

LEADING END ASSEMBLIES FOR MOVABLE PARTITIONS INCLUDING SENSOR ASSEMBLIES, MOVABLE PARTITION SYSTEMS INCLUDING SENSOR ASSEMBLIES AND RELATED METHODS

CROSS-REFERENCE TO RELATED APPLICATION

This application is a divisional of U.S. patent application Ser. No. 13/165,165, filed Jun. 21, 2011, now U.S. Pat. No. 8,544,524, issued Oct. 1, 2013, the disclosure of which is hereby incorporated herein by this reference in its entirety.

TECHNICAL FIELD

Embodiments of the present disclosure relate to sensor assemblies for movable partitions and related systems and methods. In particular, embodiments of the disclosure relate to sensor assemblies coupled to leading end assemblies of movable partitions where the sensor assemblies are configured to detect one or more of a force applied to a portion of the leading end assemblies and a displacement applied to a portion of the leading end assemblies.

BACKGROUND

Movable partitions are utilized in numerous situations and environments for a variety of purposes. Such partitions may include, for example, a movable partition comprising foldable or collapsible doors configured to enclose or subdivide a room or other area. Often such partitions may be utilized simply for purposes of versatility in being able to subdivide a single large room into multiple smaller rooms. The subdivision of a larger area may be desired, for example, to accommodate multiple groups or meetings simultaneously. In other applications, such partitions may be utilized for noise control depending, for example, on the activities taking place in a given room or portion thereof.

Movable partitions may also be used to provide a security barrier, a fire barrier, or both a security barrier and a fire barrier. For example, when implemented as a fire barrier, movable partitions may be constructed to meet certain specifications relating to fire resistance and may be utilized as fire barrier doors in condominiums, apartments, office buildings, high-rise buildings, casinos, malls, or any other location where desired or required by fire codes. The movable partitions are normally open and, when a fire is sensed, are automatically closed. In such a case, the partition barrier may be configured to automatically close upon the occurrence of a predetermined event such as the actuation of an associated alarm. For example, one or more accordion or similar folding-type partitions may be used as a security barrier, a fire barrier, or both a security barrier and a fire barrier wherein each partition is formed with a plurality of panels connected to one another with hinges. The hinged connection of the panels allows the partition to fold and collapse into a compact unit for purposes of storage when not deployed. The partition may be stored in a pocket formed in the wall of a building when in a retracted or folded state. When the partition is deployed to subdivide a single large room into multiple smaller rooms, secure an area during a fire, or for any other reason, the partition may be extended along an overhead track, which is often located above the movable partition in a header assembly, until the partition extends a desired distance across the room.

When deployed, a leading end of the movable partition, often defined by a component known as a lead post, complementarily engages a receptacle in a fixed structure, such as a wall, or engages a mating receptacle of another door. Such a receptacle may be referred to as a door jamb or a door post when formed in a fixed structure, or as a mating lead post when formed in another movable partition. It is desirable that the lead post be substantially aligned with the mating receptacle such that the movable partition may be completely closed and an appropriate seal formed between the movable partition and the mating receptacle.

When implemented as an automatic door system including, for example, a motor and a control system, the movable partition often includes various sensors and switches to assist in the control of the movable partition. For example, a conventional automatic movable partition, when used as a fire barrier, may include a button that a user may press to cease movement of the door or may include a control system that can sense a load applied to the motor driving the movable partition by an obstruction blocking the path of the movable partition while the movable partition is closing.

BRIEF SUMMARY

In some embodiments, the present disclosure includes a leading end assembly for a movable partition. The leading end assembly includes a trolley for moving the leading end assembly along an overhead track of a movable partition, a leading structure having a leading surface coupled to and suspended from the trolley, and at least one sensor assembly coupled to the leading end assembly. The at least one sensor assembly is configured to detect a force applied to the leading surface of the leading structure.

In additional embodiments, the present disclosure includes a movable partition system. The movable partition system may include a plurality of hingedly coupled panels movably coupled to a track and a leading end assembly coupled to at least one panel of the plurality of hingedly coupled panels. The leading end assembly includes a trolley movably coupled to the track and a leading structure suspended from the trolley. The leading end assembly further includes at least one sensor assembly coupled to the leading end assembly. The at least one sensor assembly is configured to detect movement of the leading structure relative to the trolley when the movable partition is moved from a retracted position to an extended position.

In yet additional embodiments, the present disclosure includes a method of operating a movable partition. The method includes moving a movable partition along a path from a retracted position to an extended position with a motor, monitoring a displacement of a leading structure of a leading end assembly of the movable partition relative to another portion of the leading end assembly with a sensor assembly coupled to the leading end assembly at a coupling between at least two components of the leading end assembly, and ceasing movement of the movable partition in response to a signal from the sensor assembly.

BRIEF DESCRIPTION OF THE DRAWINGS

While the specification concludes with claims particularly pointing out and distinctly claiming what are regarded as embodiments of the present disclosure, the advantages of embodiments of the disclosure may be more readily ascertained from the description of example embodiments of the disclosure set forth below when read in conjunction with the accompanying drawings, in which:

DETAILED DESCRIPTION

Illustrations presented herein are not meant to be actual views of any particular device, assembly, system, or method, but are merely idealized representations that are employed to describe embodiments of the present disclosure. Additionally, elements common between figures may retain the same numerical designation.

Figure 1:
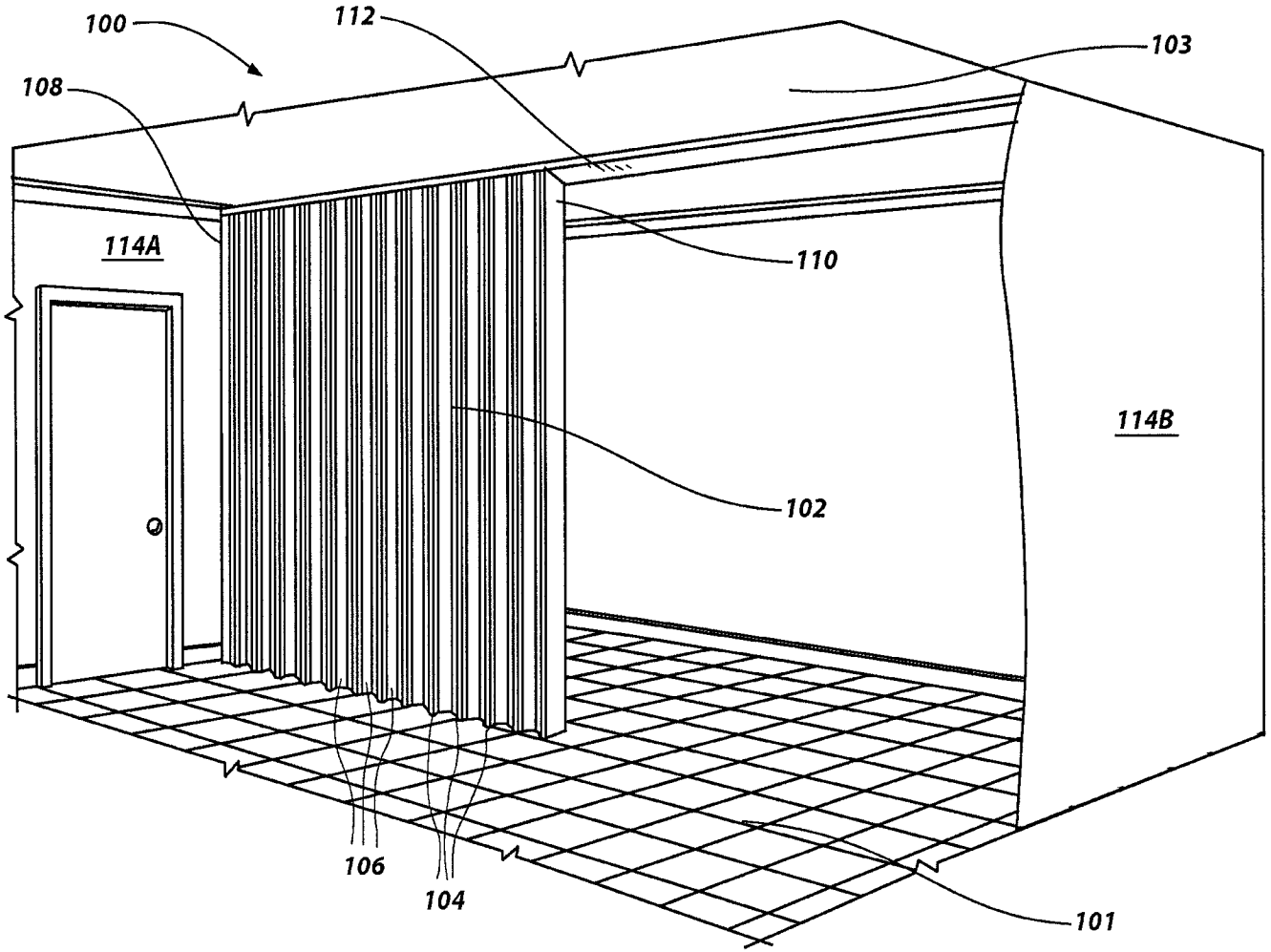
FIG. 1 is a perspective view of an embodiment of a movable partition system including a sensor assembly in accordance with an embodiment of the present disclosure.

Referring to FIG. 1, a system 100 is shown, which may also be referred to as a movable partition system 100, including a movable partition 102 in the form of an accordion-type door. The movable partition 102 may be used as a barrier (e.g., a security barrier, a fire barrier, or both a security barrier and a fire barrier). In other embodiments, the movable partition 102 may be used, for example, to subdivide a relatively larger space into relatively smaller spaces (e.g., rooms or areas). The movable partition 102 may be controlled (e.g., automatically controlled) to move between an extended position to a retracted position by a control system and motor (not shown) that may be located proximate to the movable partition system 100, in a portion of the movable partition system 100, or in location separate from the movable partition system 100. The movable partition 102 may be formed with a plurality of panels 106 that are connected to one another with hinges or other hinge-like members 104 to form a pleated (i.e., a plicated) structure. The movable partition 102 is engaged with (e.g., suspended from) an overhead track 112 along which the movable partition 102 moves as the movable partition 102 is extended (i.e., closed) and retracted (i.e., opened). The hinged connection of the panels 106 allows the movable partition 102 to be compactly stored in a movable partition storage area such as, for example, a storage pocket 108 formed in a wall 114A of a building when in a retracted or folded state.

To deploy the movable partition 102 to an extended position, the movable partition 102 is moved along the overhead track 112 to an adjoining structure positioned at an end portion of the overhead track 112. A leading end of the movable partition 102 may include a leading end assembly 110 having one or more of the panels 106 coupled thereto. For example, an end of the panels 106 forming the movable partition 102 may be coupled to the leading end assembly 110. The panels 106 may be coupled to the leading end assembly 110 in any suitable manner including, but not limited to, using adhesives, tongue and groove joints, and fasteners (e.g., screws, bolts, rivets, etc.).

The leading end assembly 110 may be configured to engage with an adjoining structure such as, for example, an opposing wall 114B, a door jamb, or a leading end assembly of another movable partition (not shown). In some embodiments, the leading end assembly 110 may be similar to the leading end assemblies described in, for example, U.S. patent application Ser. No. 12/497,310, which was filed Jul. 2, 2009 and is entitled "Movable Partitions, Leading End Assemblies for Movable Partitions and Related Methods," which is assigned to the assignee hereof and the disclosure of which is incorporated herein in its entirety by this reference. For example, a portion of the leading end assembly 110 (e.g., a leading structure 122 (FIG. 2)) may be sized to form a barrier at an open end of the pocket 108 (e.g., the end of the pocket 108 through which the movable partition 102 may be extended along the overhead track 112) when the movable partition 102 is in a retracted state. In some embodiments, the leading structure 122 (FIG. 2) may form a barrier substantially covering the open end of the pocket 108. In some embodiments, a leading surface 124 (FIG. 2) of the leading end assembly 110 may be substantially flush with a portion of the pocket 108 (e.g., the walls forming the pocket 108) when the movable partition 102 is retracted in a storage position within the pocket 108.

In other embodiments, the leading end assembly 110 of the movable partition system 100 may comprise a lead post such as, for example, the lead posts described in U.S. Pat. No. 7,845,386, which issued Dec. 10, 2010 and is entitled "Movable Partitions, Components for Movable Partitions and Related Methods," which is assigned to the assignee hereof and the disclosure of which is incorporated herein in its entirety by this reference.

While the embodiment of the movable partition 102 shown and described with reference to FIG. 1 contains a single accordion-type door, additional embodiments of the present disclosure may include multiple doors. For example, a partition may include two doors (e.g., accordion-type doors) configured to extend across a space and join together to partition a space.

Figure 2A:
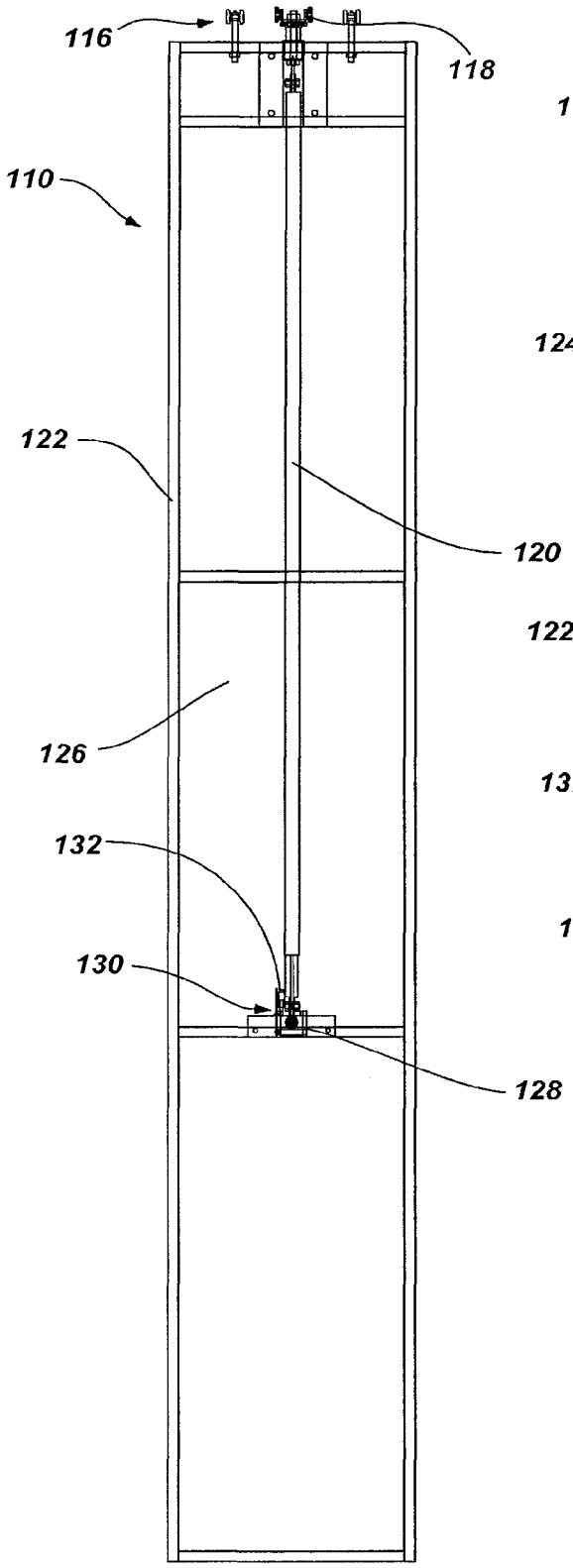
FIGS. 2A and 2B are elevation views of a leading end assembly of a movable partition system including a sensor assembly in accordance with an embodiment of the present disclosure.
Figure 2B:
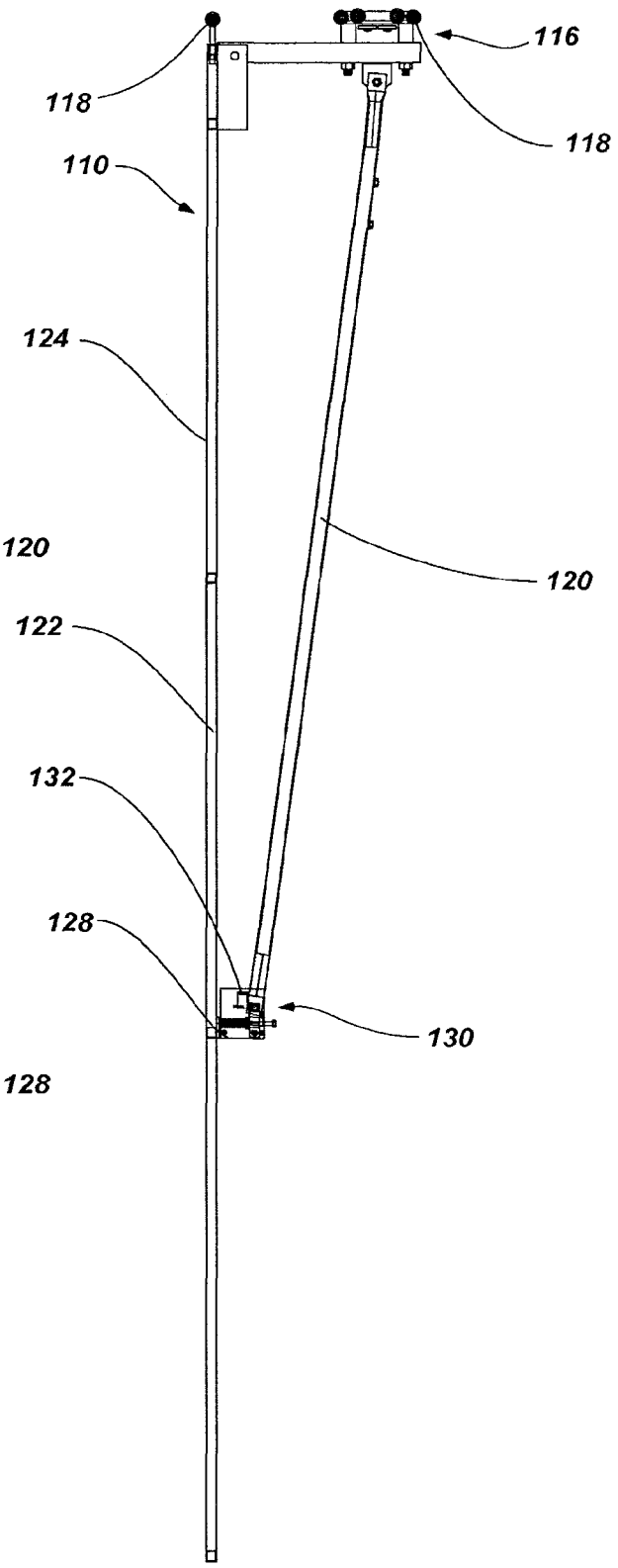

FIGS. 2A and 2B are elevation views (i.e., a trailing surface view as discussed below and a side view taken transverse to the trailing surface, respectively) of a leading end assembly for a movable partition system such as, for example, the movable partition system 100 shown and described with reference to FIG. 1. As shown in FIGS. 2A and 2B, the leading end assembly 110 may be coupled to an element that suspends the leading end assembly 110 from the overhead track 112 (FIG. 1). For example, the leading end assembly 110 may be coupled to one or more support trolleys 116 having trolley wheels 118 that are received in a portion (e.g., a channel) of the overhead track 112 to suspend the trolley 116 and leading end assembly 110 from the track 112. The trolley wheels 118 of the support trolley 116 may move along the track 112 by the rolling of the trolley wheels 118.

The leading end assembly 110 may comprise a leading portion (e.g., a leading surface 124 of the leading structure 122) that may be positioned adjacent to (e.g., in abutment with) an adjoining structure such as, for example, an opposing wall 114B (FIG. 1) or the leading end assembly of another movable partition (not shown). As used herein, "leading surface" means a distal surface of the leading end assembly 110

(e.g., the surface of an element located furthest from the point of attachment with the panels 106 of the movable partition 102 (FIG. 1)). The leading end assembly 110 may further comprise a trailing portion such as, for example, a trailing surface 126 of the leading structure 122 positioned opposite to the leading surface 124. As used herein, "trailing surface" means a proximal surface of the leading end assembly 110 (e.g., the surface of an element located at the point of attachment with the panels 106 of the movable partition 102 (FIG. 1)).

In some embodiments, the leading end assembly 110 may include a diagonal bar 120 that is coupled to the leading end assembly 110 and the support trolley 116 (e.g., at an oblique angle to the leading end assembly 110, the support trolley 116, or both). For example, the diagonal bar 120 may be coupled to a middle portion of the trailing surface 126 of the leading structure 122 (e.g., at a bracket 128 positioned between vertical ends of the leading structure 122) and to a portion of the support trolley 116. It is noted that as used herein, the term "vertical" references a vertical direction of the leading end assembly 110 as it is installed in a movable partition system 100 (i.e., vertically between a floor 101 and a ceiling 103 shown in FIG. 1). In such a configuration, the diagonal bar 120, the support trolley 116, and a portion of the leading structure 122 may form a triangle to structurally support the leading end assembly 110.

The leading end assembly 110 may include one or more sensors assemblies (e.g., sensor assembly 130) including one or more sensors (e.g., sensor 132) coupled thereto. For example, the leading end assembly 110 may include sensor assembly 130 to detect an obstruction in the path of the movable partition 102 (FIG. 1) to which the leading end assembly 110 is attached. In some embodiments, the sensor assembly 130 may be configured to detect an obstruction by sensing one or more of a force applied to one or more portions of the leading end assembly 110, a stress applied to one or more portions of the leading end assembly 110, and a displacement of one or more portions of the leading end assembly 110 (e.g., relative to another portion of the movable partition 102). For example, the sensor assembly 130 may be configured to detect a force applied to a portion of the leading end assembly 110 (e.g., to the leading structure 122) by an obstruction by detecting the displacement of a portion of the leading end assembly 110 caused by the force applied thereto.

As shown in FIGS. 2A and 2B, the sensor assembly 130 may be positioned proximate to one or more couplings between components of the leading end assembly 110. For example, the sensor assembly 130 may be positioned between the diagonal bar 120 and the leading structure 122 (e.g., at the bracket 128) and coupled to a portion of the leading end assembly 110 (e.g., to the trailing surface 126 of the leading structure 122).

Figure 3:
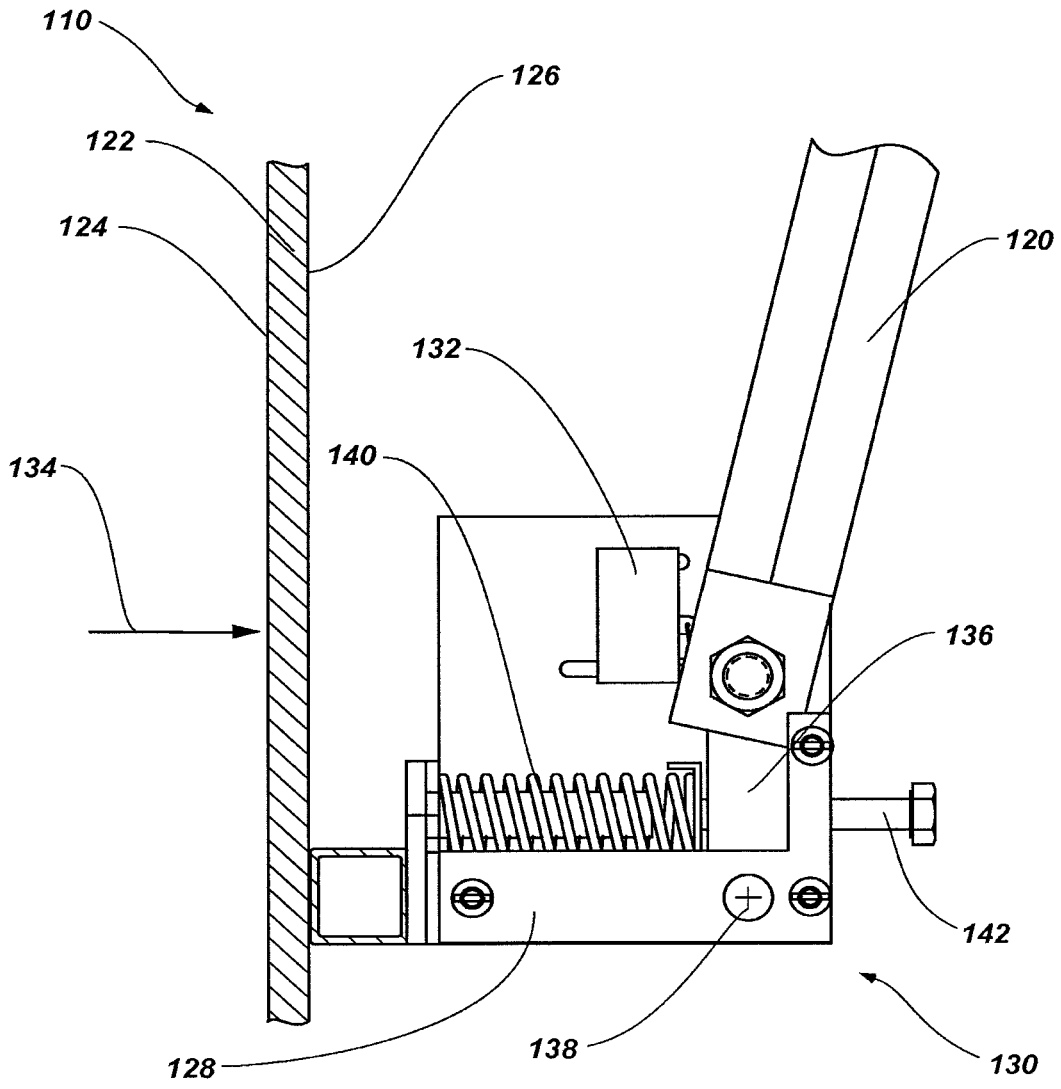
FIG. 3 is an enlarged, partial cross-sectional side view of a portion of a leading end assembly including a sensor assembly for use with a movable partition such as that shown in FIG. 1 in accordance with an embodiment of the present disclosure.

FIG. 3 is an enlarged, partial cross-sectional side view of a portion of a leading end assembly 110 including a sensor assembly for use with a movable partition 100 such as that shown in FIG. 1. As shown in FIG. 3, the sensor assembly 130 may include a sensor 132 for detecting a displacement of the leading structure 122 relative to an element connecting the leading end assembly 110 to another component of the movable partition (e.g., the support trolley 116 (FIGS. 2A and 2B)). For example, a force 134 may be applied to the leading surface 124 of the leading structure 122 (e.g., by an obstruction in the path of the leading end assembly 110). The force 134 may cause the leading structure 122 of the leading end assembly 110 to displace, for example, in a direction opposite to the path of the leading end assembly 110 when the movable partition 102 (FIG. 1) is moved from a retracted position to an extended position in order to actuate the sensor 132.

The leading structure 122 may be movably coupled to the sensor assembly 130 to enable the displacement of the leading structure 122 by the force 134 to actuate the sensor 132. For example, the diagonal bar 120 may be coupled to the sensor assembly 130 to enable the diagonal bar 120 to pivot (e.g., in a direction toward the leading structure 122) as the force 134 is applied to the leading surface 124 of the leading structure 122. In some embodiments, the diagonal bar 120 may be pivotably mounted to a movable arm 136 that is mounted to the bracket 128 at pivot point 138 enabling the movable arm 136 to rotate with respect to the bracket 128 and the leading structure 122. Movement of the movable arm 136 may enable a portion of the movable arm 136 to actuate the sensor 132 (e.g., by contacting a portion of the sensor 132 such as a switch). In some embodiments, the diagonal bar 120 may be pivotably coupled to the movable arm 136 to enable the diagonal bar 120 to rotate as the movable arm 136 pivots about pivot point 138.

In some embodiments, a portion of the leading end assembly 110 may be biased into an initial position in which the sensor 132 is not triggered to enable normal operation of the leading end assembly 110 and movable partition 102 (FIG. 1). For example, biasing member 140 (e.g., a spring) may act to bias the movable arm 136 in an initial position where it does not actuate the sensor 132. When a force 134 is applied to the leading structure 122 having a sufficient magnitude to overcome the biasing force of the biasing member 140, the movable arm 136 may move, compressing the biasing member 140, in order to actuate the sensor 132. When the force 134 is insufficient to overcome the biasing force of the biasing member 140, the biasing member 140 may force the movable arm into a position where the movable arm 136 no longer actuates the sensor, thereby, enabling normal operation of the movable partition 102 (FIG. 1). In some embodiments, the biasing member 140 may include an adjustment feature 142 enabling adjustment of the amount of force 134 necessary to overcome the biasing member 140 to actuate the sensor 132.

In some embodiments, the leading end assembly 110 may include a linkage (e.g., the movable arm 136) to amplify the amount of displacement of a portion of the leading end assembly 110 (e.g., the leading structure 122) to substantially ensure actuation of the sensor 132. For example, a linkage of the leading end assembly 110 may be sized, configured, positioned, or combinations thereof such that a displacement of the leading structure 122 may cause a relatively greater displacement of a portion of the linkage proximate to the sensor 130 in order to enable the portion of the linkage to actuate the sensor 130.

Figure 4:
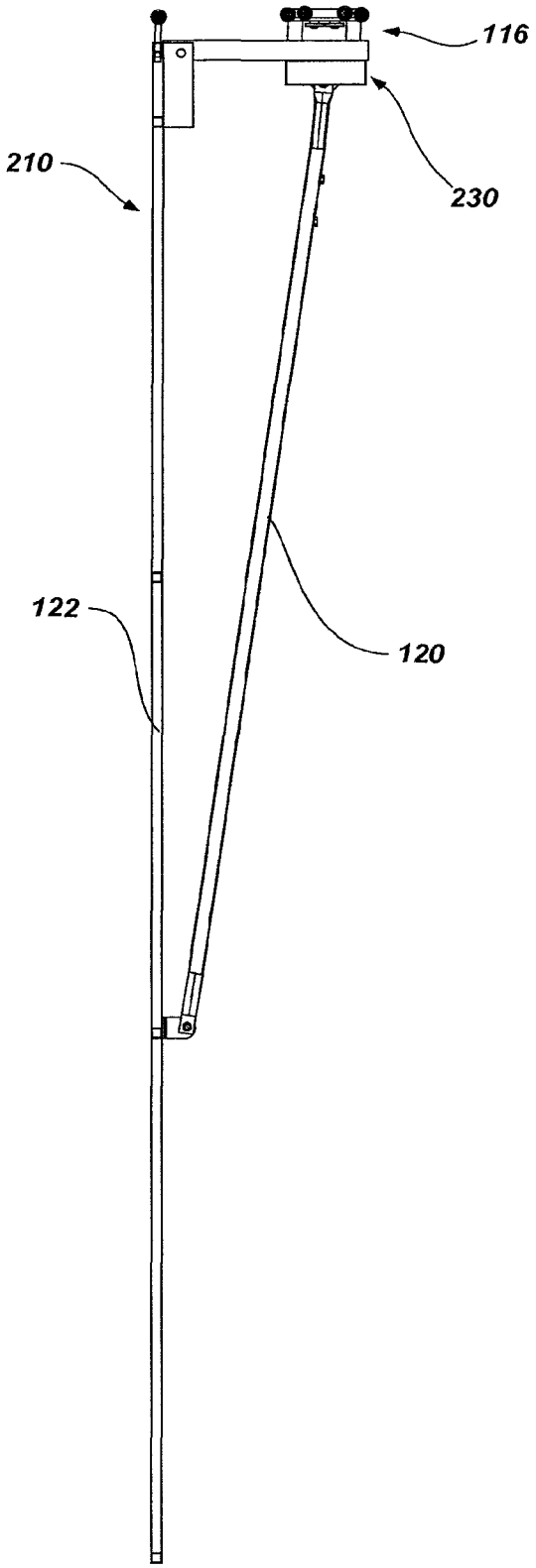
FIG. 4 is a side view of a leading end assembly of a movable partition system including a sensor assembly in accordance with another embodiment of the present disclosure.

It is noted that while the embodiment of FIGS. 2A and 2B illustrates the sensor assembly 130 as being positioned at a coupling between the diagonal bar 120 and the leading structure 122, the sensor assembly 130 may be positioned at any suitable location of the leading end assembly 110. For example, FIG. 4 is a side view of a leading end assembly 210 of a movable partition system such as the movable partition system 100 (FIG. 1) including a sensor assembly 230. The leading end assembly 210 may be similar to the leading end assembly 110 shown and described with reference to FIGS. 1, 2A, and 2B. The leading end assembly 210 may include a sensor assembly 230 that may be similar to the sensor assembly 130 shown and described with reference to FIGS. 2A, 2B, and 3. For example, the sensor assembly 230 may include one or more sensors for detecting one or more of a force applied to one or more portions of the leading end assembly 210, a stress applied to one or more portions of the leading end assembly 210, and a displacement of one or more portions of the leading end assembly 210. As shown in FIG. 4, the sensor assembly 230 may be positioned at a coupling between the diagonal bar 120 and the support trolley 116 of the leading end assembly 210. As above, a force applied to the leading structure 122 may trigger one or more sensors of the sensor assembly 230. For example, movement of the leading structure 122 (e.g., under the force applied thereto) may displace the leading structure 122 and the diagonal bar 120 relative to the support trolley 116 and may trigger one or more sensors of the sensor assembly 230.

Figure 5:
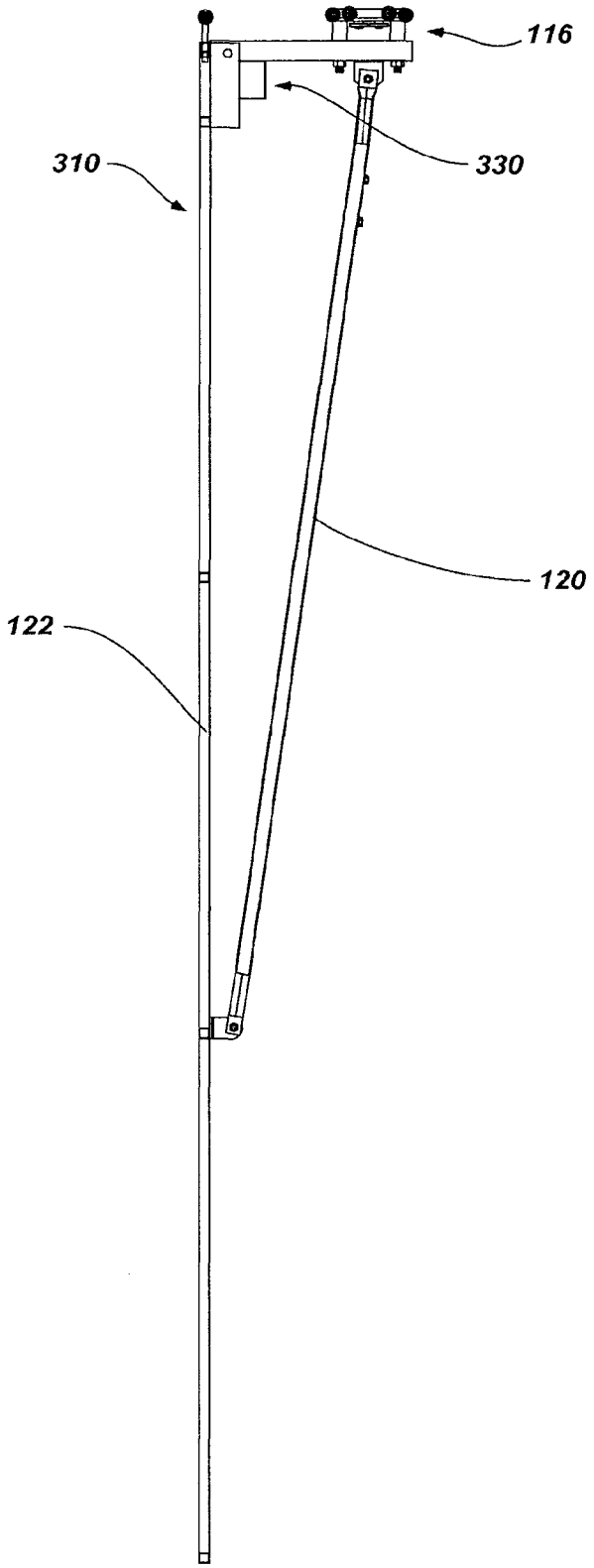
FIG. 5 is a side view of a leading end assembly of a movable partition system including a sensor assembly in accordance with yet another embodiment of the present disclosure.

FIG. 5 is a side view of a leading end assembly 310 of a movable partition system such as the movable partition system 100 (FIG. 1) including a sensor assembly 330. The leading end assembly 310 may be similar to the leading end assembly 110 shown and described with reference to FIGS. 1, 2A, and 2B. The leading end assembly 310 may include a sensor assembly 330 that may be similar to the sensor assembly 130 shown and described with reference to FIGS. 2A, 2B, and 3. For example, the sensor assembly 330 may include one or more sensors for detecting one or more of a force applied to one or more portions of the leading end assembly 310, a stress applied to one or more portions of the leading end assembly 310, and a displacement of one or more portions of the leading end assembly 310. As shown in FIG. 5, the sensor assembly 330 may be positioned at a coupling between the leading structure 122 and the support trolley 116 of the leading end assembly 310. As above, a force applied to the leading structure 122 may trigger one or more sensors of the sensor assembly 330. For example, movement of the leading structure 122 (e.g., under the force applied thereto) may displace the leading end relative to the support trolley 116 and may trigger one or more sensors of the sensor assembly 330.

Figure 6:
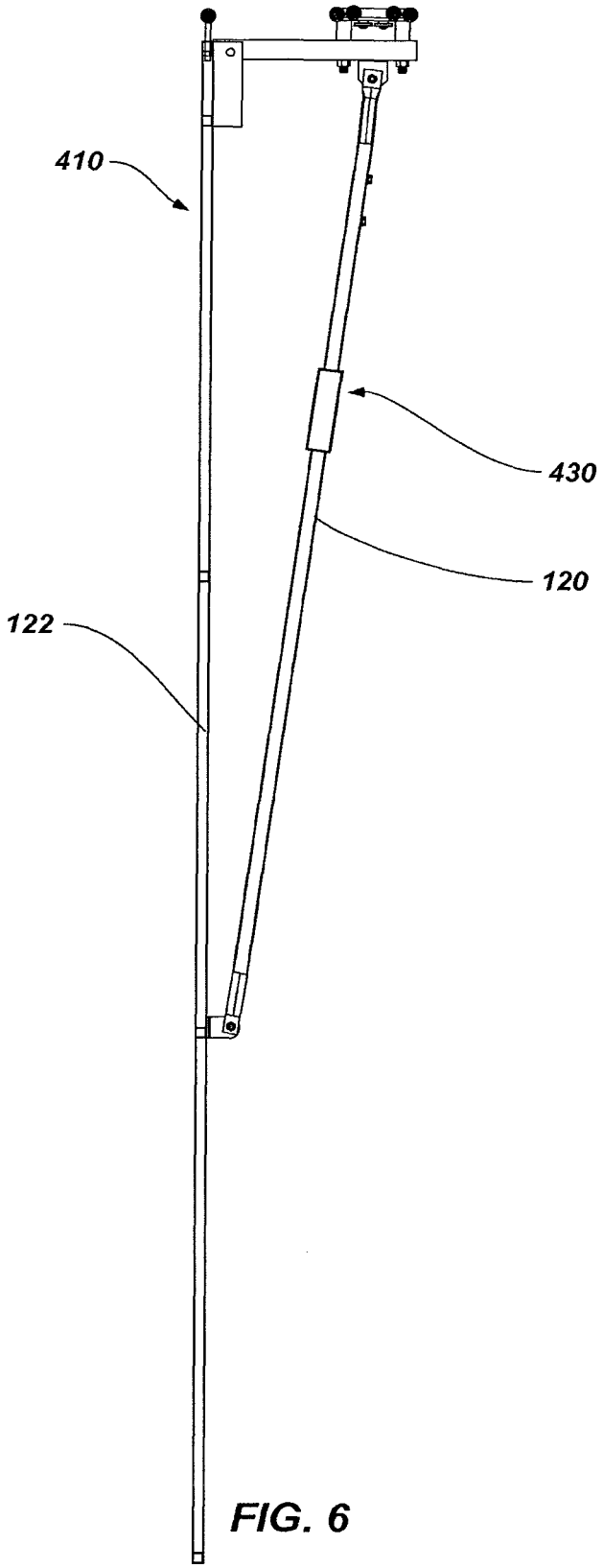
FIG. 6 is a side view of a leading end assembly of a movable partition system including a sensor assembly in accordance with yet another embodiment of the present disclosure.

FIG. 6 is a side view of a leading end assembly 410 of a movable partition system, such as the movable partition system 100 (FIG. 1), including a sensor assembly 430. The leading end assembly 410 may be similar to the leading end assembly 110 shown and described with reference to FIGS. 1, 2A, and 2B. The leading end assembly 410 may include a sensor assembly 430 that may be similar to the sensor assembly 130 shown and described with reference to FIGS. 2A, 2B, and 3. For example, the sensor assembly 430 may include one or more sensors for detecting one or more of a force applied to one or more portions of the leading end assembly 410, a stress applied to one or more portions of the leading end assembly 410, and a displacement of one or more portions of the leading end assembly 410. As shown in FIG. 5, the sensor assembly 430 may be positioned along components of the leading end assembly 410 (e.g., along the diagonal bar 120). As above, a force applied to the leading structure 122 may trigger one or more sensors of the sensor assembly 430. For example, movement of the leading structure 122 (e.g., under the force applied thereto) may act to apply a force to the diagonal bar 120. The sensor assembly 410 may configured to measure a result of the force applied to the diagonal bar 120 (e.g., an amount of stress or strain applied to the diagonal bar 120, a displacement of the diagonal bar 120, a deformation of the diagonal bar 120, or combinations thereof) and may trigger one or more sensors of the sensor assembly 430.

Figure 7:
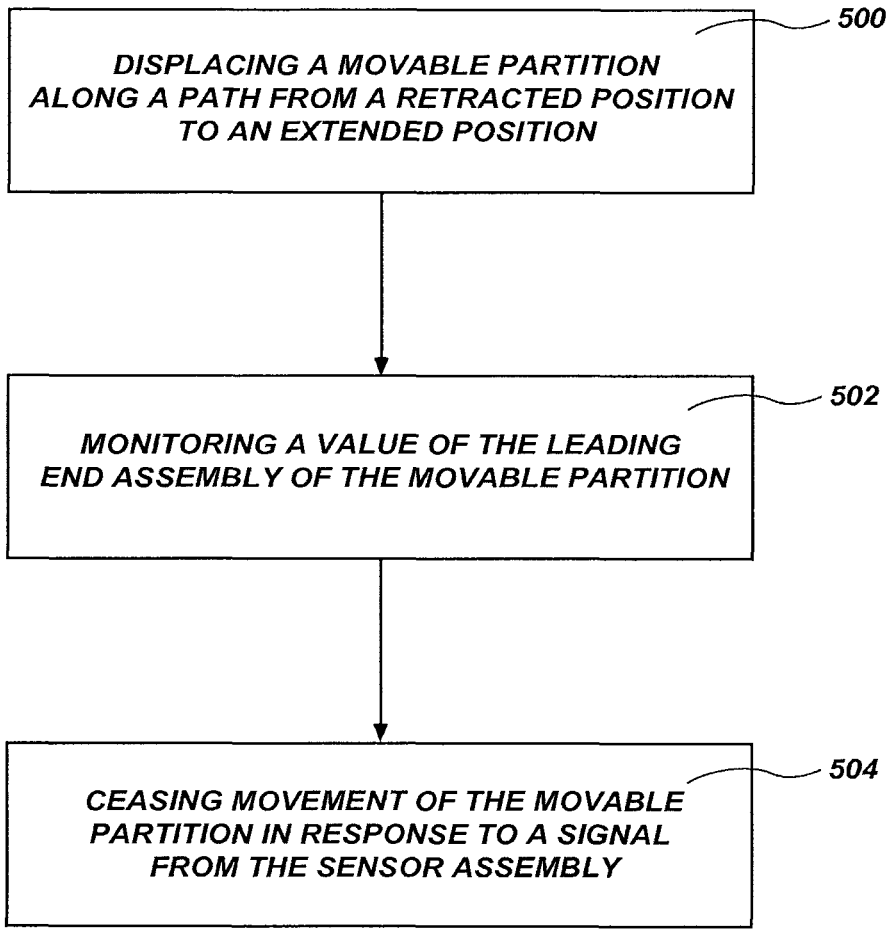
FIG. 7 is a flow chart illustrating an embodiment of a method that may be used to operate a movable partition like that shown in FIG. 1.

FIG. 7 is a flow chart illustrating an embodiment of a method that may be used to operate a movable partition like that shown in FIG. 1. As shown in FIG. 7, in act 500, a method of operating a movable partition may include moving a movable partition along a path from a retracted position to an extended position with a motor.

In act 502, a sensor coupled to a portion of a leading end assembly of the movable partition may be configured to monitor a value of at least one of a force, displacement (e.g., rotational or angular displacement, translation, or combinations thereof), stress, or combinations thereof of the leading end assembly. For example, the sensor may be configured to sense a displacement of a portion of the leading end assembly (e.g., a leading structure) greater than a threshold value (e.g., a value greater than a value of the leading end assembly in an initial state) applied to a leading end assembly (e.g., by an obstruction in the path of the movable partition). In some embodiments, displacement of the leading structure relative to an element suspending the leading end assembly from an overhead track along which the movable partition is moved may actuate the sensor assembly.

In act 504, when a force above the threshold value is sensed, movement of the movable partition may be ceased (e.g., movement of the movable partition may be halted. movement of the movable partition may be reversed, or combinations thereof). For example, movement of the movable partition (e.g., in a first direction) may be halted and/or reversed (e.g., displaced in a second direction opposite to the first direction) in response to a signal from the sensor assembly. In some embodiments, after the value sensed by the sensor assembly returns to less than the threshold value, the movement of the movable partition by the motor may continue along the path.

In view of the foregoing, sensor assemblies in accordance with embodiments of the present disclosure may provide enhanced sensing of obstructions in a path of a movable partition. For example, such sensor assemblies may be configured to detect displacement of a portion of a leading end assembly of a movable partition relative to the movement of the leading end assembly's movement along a track to which it is secured. That is, a force applied to a portion of the leading end assembly external to the movement of the leading end assembly along the track may be detected by the sensor assembly. When such a force is detected, the sensor assembly may act to cease operation of the motor driving the movable partition to avoid damage to the movable partition or to users of the movable partition and to enable passage through the opening in which the movable partition is installed.

While the present disclosure has been described herein with respect to certain embodiments, those of ordinary skill in the art will recognize and appreciate that it is not so limited. Rather, many additions, deletions and modifications to the described embodiments may be made without departing from the scope of the disclosure as hereinafter claimed, including legal equivalents. In addition, features from one embodiment may be combined with features of another embodiment while still being encompassed within the scope of the disclosure as contemplated by the inventors.

What is claimed is:

1. A movable partition system, comprising:

a movable partition comprising:

a plurality of hingedly coupled panels movably coupled to an overhead track;

a trolley positioned in and movable along the overhead track;

a leading structure having a leading surface laterally positioned to define a majority of a leading side of the movable partition and to lead the plurality of hingedly coupled panels along the overhead track, the leading structure coupled to and suspended from the trolley at a mechanical linkage coupling a leading end portion of the trolley and an upper portion of the leading structure proximate a location where the trolley is configured to engage with the overhead track; and at least one sensor assembly positioned solely at the mechanical linkage between the trolley and the leading structure, the at least one sensor assembly associated with the mechanical linkage and configured to detect a force applied to the leading surface of the leading structure by directly detecting displacement in the mechanical linkage caused by movement of at least a portion of the leading structure relative to the trolley in a direction along a length of the overhead track.

2. The movable partition system of claim 1, further comprising a diagonal element extending from the trolley at an oblique angle to the leading structure.

3. The movable partition system of claim 1, wherein the at least one sensor assembly comprises a stress sensor configured to sense a stress applied to the coupling between the trolley and the leading structure resulting from the force applied to the leading surface of the leading structure.

4. The movable partition system of claim 1, wherein the at least one sensor assembly comprises a force sensor configured to sense a force applied to the coupling between the trolley and the leading structure resulting from the force applied to the leading surface of the leading structure.

5. The movable partition system of claim 1, wherein the at least one sensor assembly is configured to sense a displacement of the coupling between the trolley and the leading structure resulting from the force applied to the leading surface of the leading structure.

6. The movable partition system of claim 5, wherein the at least one sensor assembly is configured to sense a displacement of the leading structure relative to the trolley.

7. The movable partition system of claim 1, wherein the at least one sensor assembly comprises an adjustment feature configured to adjust the sensitivity of at least one sensor of the at least one sensor assembly to a displacement of the leading structure of the leading end assembly.

8. A movable partition system, comprising:

a movable partition comprising:

a plurality of hingedly coupled panels movably coupled to a track; and a leading end assembly coupled to at least one panel of the plurality of hingedly coupled panels at a position laterally leading each panel of the plurality of hingedly coupled panels in a direction along a path which the movable partition travels from a retracted position to an extended position, the leading end assembly comprising:

a trolley disposed in and movably coupled to the track; and a leading structure suspended from the trolley; and at least one sensor assembly coupled to the leading end assembly at a location proximate to the trolley of the leading end assembly, the at least one sensor assembly configured to detect movement of at least a portion of the leading structure relative to the trolley in the direction along the path which the movable partition travels from the retracted position to the extended position when the movable partition is moved from the retracted position to the extended position by directly detecting displacement of the leading structure relative to the trolley only at the location of the at least one sensor assembly proximate to the trolley.

9. The movable partition of claim 8, wherein the at least one sensor assembly is coupled to the leading end assembly at a coupling between the trolley and the leading structure.

10. The movable partition of claim 8, wherein the at least one sensor assembly is coupled to the leading end assembly at a coupling between the trolley and a diagonal element extending from the trolley at an oblique angle to the leading structure.

11. The movable partition of claim 8, wherein the leading structure of the leading end assembly is configured to abut with an adjoining structure when the movable partition is in the extended position.

12. The movable partition of claim 11, wherein the leading structure comprises an elongated lead post having a leading surface substantially smaller than an opening to a storage pocket for the movable partition.

13. The movable partition system of claim 11, wherein the leading structure comprises a planar leading surface having a size and shape configured to cover an opening to a storage pocket for the movable partition.

14. The movable partition system of claim 8, wherein the at least one sensor assembly is configured to detect a force applied to the leading structure in a direction opposite to a direction of a path which the movable partition travels from the retracted position to the extended position.

15. A method of operating a movable partition, the method comprising:

moving a movable partition along an overhead track from a retracted position to an extended position with a motor;

monitoring a displacement of a leading structure of a leading end assembly of the movable partition relative to a trolley in a lateral direction extending parallel to the overhead track with a sensor assembly coupled to the leading end assembly solely at a location proximate to a coupling between the trolley and the leading structure, the trolley disposed in the overhead track and for moving the leading end assembly along the overhead track; and ceasing movement of the movable partition in response to a signal from the sensor assembly.

16. The method of claim 15, wherein monitoring a displacement of the leading structure comprises sensing a value that is greater than a threshold value, the value comprising at least one of a force applied to a portion of the leading end assembly, a displacement of a portion of the leading end assembly, and stress applied to a portion of the leading end assembly.

17. The method of claim 16, further comprising continuing to move the movable partition along the path when the value sensed by the sensor assembly is less than the threshold value.

18. The method of claim 15, wherein monitoring a displacement of the leading structure comprises sensing at least one of a displacement and a force applied to the leading end assembly by an obstruction in the path of the movable partition.

19. The method of claim 15, wherein ceasing movement of the movable partition comprises at least one of halting movement of the movable partition in a first direction and reversing movement of the movable partition in a second direction opposite to the first direction.

* * * * *